US006077329A

United States Patent [19]

Higa et al.

[11] Patent Number: 6,077,329

[45] Date of Patent: Jun. 20, 2000

[54] SELECTION OF SIZE OF ALUMINUM PARTICLES PREPARED BY SOLUTION METHOD

[75] Inventors: Kelvin T. Higa; Curtis E. Johnson; Richard A. Hollins, all of Ridgecrest, Calif.

[73] Assignee: The United States of America as represented by the Secretary of the Navy, Washington, D.C.

[21] Appl. No.: 09/062,694

[22] Filed: Apr. 20, 1998

Related U.S. Application Data

[62] Division of application No. 08/684,781, Jul. 22, 1996, Pat. No. 5,885,321.

[51] Int. Cl.[7] ..... C22B 21/02; B22F 9/24

[52] U.S. Cl. ..... 75/722; 75/362; 75/371

[58] Field of Search ..... 75/362, 371, 722

[56] References Cited

U.S. PATENT DOCUMENTS 3,578,436 5/1971 Becker et al. ..... 75/362

*Primary Examiner*—Prince Willis
*Assistant Examiner*—Tima McGuthry-Banks
*Attorney, Agent, or Firm*—David S. Kalmbaugh

[57] ABSTRACT

Fine aluminum powders are prepared by decomposing alane-adducts in organic solvents under an inert atmosphere to provide highly uniform particles and believed particularly effective as fuels and additives, in pyrotechnics, and in energetic materials. Effective adduct species are trialkyl amines and tetramethylethylenediamine, ethers and other aromatic amines. Effective production is obtained at atmospheric pressure and at temperatures as low as 50° C. with xylene solvent. Toluene, dioxane, and tetramethylethylenediamine were also effective solvents. Aliphatic solvents and other aromatic and polar solvents are believed effective. Titanium catalyst was provided as a halide, amide, and alkoxide; and it is believed that the corresponding compounds of zirconium, hafnium, vanadium, niobium, and tantalum are effective as catalysts. Particle size was controlled by varying catalyst concentration and by varying the concentration of an adducting species. It is believed that particle size is controllable by varying the catalyst, concentration of the reactants, polarity of the solvent, reaction temperature, and the stage and rate at which the solution is brought to this temperature. The product powder is passivated in the reaction vessel by exposing the solution to air before product separation or by controlling the admission of air to the separated, dried powder.

1 Claim, No Drawings

SELECTION OF SIZE OF ALUMINUM PARTICLES PREPARED BY SOLUTION METHOD

CROSS REFERENCE TO RELATED APPLICATION

This application is a division of application Ser. No. 08/684,781 filed Jul. 22, 1996 now U.S. Pat. No. 5,885,321 issued on Mar. 23, 1999.

BACKGROUND OF THE INVENTION

1. Field of the Invention

The present invention is related to specialized metallurgical processes wherein a powder is prepared by the decomposition of an organo-metallic compound in a solution from which the free metal settles.

2. Description of the Prior Art

Fine aluminum powders, for the purposes of the present application, are defined as having particle sizes substantially less than the about 3000–200,000 nm currently available in quantity and obtained by grinding or by spraying into an inert atmosphere. These currently available particles are also of greatly varying size. For example, examination by scanning electron microscopy (SEM) has shown nominal 3000 and 5000 nm powders produced by such spraying to have sizes ranging, respectively, from 200–8500 nm and from 200–11000 nm.

The fine aluminum powders are believed to increase the effectiveness of fuels and fuel additives, pyrotechnics, and energetic materials including composites, thermite, and explosives by a factor of three to ten, this increase being due to the more rapid and complete reaction of the finer particles.

However, this advantage is only practically obtainable if the fine powders can be produced in relatively large quantity and in pre-determined, uniform sizes selectable for the particular use. It is desirable that a method for producing such fine powders in quantity not require expensive equipment, use readily obtainable pressures and temperatures, use relatively inexpensive and non-toxic materials, and provide convenient separation of the product in storable form. Since fine powders of pure aluminum are pyrophoric, it is highly desirable that a practical method for producing such powders provide them in a form that is passivated and yet contains a large amount of pure aluminum.

Insofar as known to the present applicants, there has heretofore been no method that is in accordance with the above listed requirements and advantages and that produces aluminum powders in quantity and with particles of uniform and selectable sizes from 65–500 nm.

Fine aluminum powders have been prepared by exploding aluminum wire in a vacuum by a high electric current; a method requiring expensive equipment. This method provides little or no control of particle size or uniformity, and transmission electron microscopy of its product has shown particles ranging from 50 to 1000 nm in diameter. Very fine aluminum powders have also been prepared by condensation of vaporized aluminum in a current of cold, inert gas; however, relatively high temperatures are required to vaporize the aluminum; expensive equipment is required; and production is relatively slow.

Other metals have been prepared in powder form by decomposition of the carbonyl and by reduction of metal halides in solution. However and insofar as known to applicants, there are no aluminum carbonyls and it is relatively difficult to separate metal powders from the salt solution resulting from such halide reduction.

It is known to plate aluminum on a substrate by the decomposition of a tertiary amine complex of aluminum hydride in vapor form at pressures of up to 30 mm of mercury without a catalyst and at temperatures of 125 to 550° C. Chemical vapor deposition has also been used to plate aluminum from alane adducts on bulk titanium and on silicon. With silicon, $(Me_3N)_2AlH_3$ vapor was used at about 0.2 Torr after treatment with $TiCl_4$ vapor to improve film uniformity and provide average film grain sizes of 1000 nm at 180° C. and 150 nm at 100° C.

U.S. Pat. No. 3,462,288, which issued Aug. 19, 1969, discloses plating aluminum on a substrate from an alkyl or aryl substituted aluminum hydride complexed with an ether or a nitrogen containing compound and catalysed by a compound of "the metals occurring in Groups IVa or Vb of the Periodic Table". It is suggested that the aluminum hydride be employed in solvated form, not only by oxygen or nitrogen containing compounds, but by sulfur or phosphorus containing compounds. It is not mentioned that these latter compounds which, together with arsenic compounds which may also be effective, are typically highly toxic. In one example, the substrate was immersed in a diethyl ether solution of the catalyst, dried at 100° C., immersed in a solution of aluminum hydride in diethyl ether, and again dried at room temperature with an aluminum coating forming in a few minutes where the substrate was contacted by the catalyst solution. In other examples, deposition of the aluminum plate did not occur on a substrate treated with the substituted aluminum hydride and catalyst until initiated by energy in the form of heat, actinic light, or high energy radiation.

It is apparent that generating a powder having uniform particles of a predetermined size from plating or a film on a substrate presents at least as many problems as generating such a powder from bulk metal.

U.S. Pat. No. 3,535,108, which issued Oct. 20, 1970, and U.S. Pat. No. 3,578,436, which issued May 11, 1971 to the same inventors, disclose methods for producing purified aluminum in particulate form by the conversion of "crude" aluminum to a dialkylaluminum hydride followed by decomposition of the dialkylaluminum hydride at room to 260° C. temperatures into the purified aluminum together with the corresponding trialkylaluminum and hydrogen which are recycled to convert further crude aluminum into the dialkylaluminum hydride. The reaction system was, apparently, thought to require a tertiary amine as well as a catalyst including at least one compound of titanium, zirconium, hafnium, vanadium, a lanthanide, or an actinide in an weight ratio of 0.01 through 0.00001 to the produced aluminum. However, it was discovered that the tertiary amine need not be present. Evidently, the size and uniformity of the aluminum particles was uncontrolled except that it was thought advantageous to increase the average size of the particles by seeding the system with "finely divided aluminum powder".

In a related method, decomposition of diethylhydridoaluminum or diisobutylhydridoaluminum in diisopropyl ether or triethylamine at 90 to 185° C., produced at least 99.97 percent pure particulate aluminum along with twice the molar quantity of the corresponding trialkylaluminum. Titanium isopropoxide catalyst was used in an amount by weight of 1 part per 3000 parts aluminum produced, and the particles were nonpyrophoric conglomerates of 500,000 nm. These conglomerates were reducible by "intense grinding" to 420 nm mean particle diameter based on surface area measurement.

SUMMARY OF THE INVENTION

Fine aluminum powders are prepared by decomposing alane-adducts in organic solvents under an inert atmosphere to provide highly uniform particles selectably sized from about 65 nm to about 500 nm. Trialkyl amines, tetramethylethylenediamine, and dioxane are effective adduct species, and other aromatic amines and ethers are believed effective. Effective production is obtained at atmospheric pressure and at temperatures as low as 50° C. with xylene as the solvent. Higher production rate is achieved at higher temperatures. Aromatic, polar, and aliphatic solvents are all believed effective. Titanium was effective as a catalyst when provided as a halide, amide, and alkoxide; and it is believed that other titanium compounds and the corresponding compounds of zirconium, hafnium, vanadium, niobium, and tantalum are effective as catalysts.

The particle size was controlled by, first, varying catalyst amount and, second, by varying the amount of an adducting species, as by adding an adducting amine to the solution or using an adducting amine as the solvent. As determined by examination of scanning electron micrographs (SEM's), these two variations select particles which are in the above mentioned range of about 65 nm to about 500 nm and which have a uniformity of, for example, 200–300 nm for one selected size. It is believed that the particle size may also be controlled by varying the catalyst, concentration of the reactants, polarity of the solvent, the reaction temperature, and the stage and rate at which the solution is brought to this temperature.

Aluminum powders produced by the present invention may be separated from the reaction solution in any suitable manner as by filtration through frit or by cannulating off the organic solvent after precipitation of the aluminum powder. The powders are then purified in any suitable manner as by washing with pure solvent and drying under vacuum The present invention includes convenient passivation of the produced aluminum powder product in the reaction vessel either by exposing the solution to air before product separation or by controlling the admission of air to the separated, dried powder.

It is an object of the present invention to provide a method of producing fine aluminum powders having particles of uniform size in a range from at least about 65 nm to about 500 nm.

A particular object is to provide such a method in which the size of the particles may be selected.

Another object is to provide such a method which is suited for bulk production of such powders, which uses relatively simple and inexpensive equipment, which uses relatively inexpensive ingredients, and in which substantial production is obtained at relatively low temperature and atmospheric pressure.

A further object is to provide such a method in which the produced fine powders are highly purified, are easily separated, and are in a form for storage and use.

DETAILED DESCRIPTION OF THE INVENTION

In the present invention, fine aluminum powders are formed under an inert atmosphere by decomposition reactions of alane adducts in organic solvent solutions containing a catalyst and, optionally, further amounts of the adduct species or a related species. The reactions occur at desired reaction temperatures which may be attained by heating an alane adduct solution before or after adding the catalyst or by adding the alane adduct to a catalyst solution already at the reaction temperature.

The alane adducts are characterized by a relatively strong bond with electron exchange between the alane, $H_3Al$, and the adducting species such as trimethylamine, $(CH_3)_3N$, which distinguishes the alane adducts from related complexed or solvated compounds which may form in solution and have weaker bonds. The alane adducts are further characterized by the aluminum not being bonded directly to an alkyl radical or an amine radical, but directly to three hydrogen atoms.

It is believed that the adducting species can be trialkyl (NRR'R") and aromatic amines such as trimethylamine, dimethylethylamine, triethylamine, methyldiethylamine, tripropylamine, triisopropylamine, tributylamine, pyridine, and tetramethylethylenediamine (TMEDA); and ethers (ROR') such as dimethyl ether, diethyl ether, propyl ether, isopropyl ether, dioxane, tetrahydrofuran, dimethoxymethane, diglyme, triglyme, and tetraglyme.

The use of these alane adducts in solution and in accordance with the methods of the present invention directly produces aluminum particles of uniform size. This size is selectable in accordance with the present invention by varying the concentration of the catalyst and by varying the concentration of an adducting species as by adding this species in uncompounded form to a solution of an alane adduct or by using an adducting species itself as the solvent. The concentration of a solid adducting species is, of course, limited to the maximum amount dissolvable in a selected solvent, while the concentration of an added liquid adducting species such as dimethylethylamine is not so limited.

It is apparent that when the adducting species is an amine and such a compound added to the solution is also an amine, this added amine is independent of the bonded amine in the alane adduct and thus may be the same as or a different species than the adducting species. For this purpose, TMEDA has been found effective both as the same and as a different species. The added species may displace the original adducting species as when TMEDA is added to a solution of trimethylamine alane adduct. It is believed that many other amines including at least trimethylamine, dimethylethylamine, methyldiethylamine, triethylamine, tripropylamine, triisopropylamine, tributylamine, and pyridine may also be effective as such added amine.

The use of these alane adducts in solution in accordance with the method of the present invention also permits control of the size of the directly produced particles by selection of such variables as solution temperature, rate and step of the method wherein this temperature is attained, variation of the adducting species as introduced initially with the alane adduct or by later addition. This flexibility and selectibility in direct production of aluminum particles is unknown in the prior art where the adducts were used without catalyst in chemical vapor deposition to form continuous aluminum plating or where other aluminum compounds than alane adducts were used in solution to produce particles in sizes that were simply accepted and certainly uncontrolled and where the uniformity of the size was unstated.

Adducts similar to those presently disclosed may be effective for the production of powders of other metals than aluminum. These adducts for the production of aluminum and other metals may include other electron donor compounds than amines and ethers and may include the above-mentioned compounds of sulfur, phosphorus, and arsenic although disadvantageous because of their toxicity.

Toluene, TMEDA, xylene, and dioxane have been found effective solvents. However, it is believed that the solvent can be any aromatic solvent such as toluene, benzene, and mesitylene; a polar solvent such as propyl ether, isopropylether, dimethoxymethane, tetrahydrofuran, diglyme, triglyme, and tetraglyme; an aliphatic solvent such as hexane, heptane, octane, and nonane; or an amine such as triethylamine, tripropylamine, triisopropylamine, and pyridine. It is apparent that the usual inorganic solvents, such as water, liquid carbon dioxide, and ammonia would react directly with the alane so there would be no pure aluminum produced.

Titanium (IV) chloride, $TiCl_4$; titanium (IV) isopropoxide, $(i\text{-}PrO)_4Ti$; and titanium (IV) dimethylamide, $Ti(NMe_2)_4$, have been found effective catalysts. However, it is believed that the catalyst can be other compounds of titanium, zirconium, hafnium, vanadium, or niobium including a halide such as $TiX_4$, $ZrX_4$, $HfX_4$, $VX_3$, $VX_4$, $VOCl_3$, $NbX_3$, $NbX_4$, $NbX_5$, $TaX_5$ where X=F, Cl, Br, I; an alkoxide such as $Ti(OR)_4$, $Zr(OR)_4$, $Hf(OR)_4$, $V(OR)_3$, $Nb(OR)_3$, $Nb(OR)_5$, $Ta(OR)_5$; or an amide such as $Ti(NR_2)_4$, $Zr(NR_2)_4$, $Hf(NR_2)_4$, $V(NR_2)_x$, $Nb(NR_2)_{(3,4,5)}$, $Ta(NR_2)_5$, where R is an alkyl group such as methyl, ethyl, propyl, isopropyl, butyl, or tert-butyl.

It is possible that compounds of other metals may be effective as catalysts for the practice of the present invention since the action of the presently used catalysts is not well understood in the art and since the use of lanthanides and actinides has, as before mentioned, been suggested for decomposition of metal organic compounds into powders.

It is believed that the inert atmosphere can be any non-reactive gas such as nitrogen, argon, helium, or neon.

The present invention is highly advantageous in that its reactions, which have no inherent temperature or pressure limitations, are effective at relatively low temperatures and at atmospheric pressure thereby avoiding expensive equipment and energy. The reactions of the present invention are productive at room temperature, and higher temperatures provide greater production up to the solvent boiling point which, without pressurization and with suitable solvents, might be at least 240° C. However and since effective production has been obtained at 50° C. and steam is convenient for heating to 90–95° C., the most practical conditions may use less expensive and lower boiling point solvents, such as toluene.

The aluminum powders may be isolated from the reaction solvent mixture in any suitable manner, as by cannulation or filtration followed by washing with fresh solvent and then drying. This isolation is facilitated by the efficiency of the present reaction in which no byproducts containing aluminum from the basic alane-adduct are inherently produced. The present invention advantageously provides passivation of the produced fine aluminum powders by slow oxidation in the reaction vessel by admitting air thereto either before or after separating the powders from the solvent.

As before stated, it is believed that particle size of fine aluminum powders produced in accordance with the present invention may be controllable by varying the catalyst, concentration of the reactants, polarity of the solvent, reaction temperature, and the stage and rate at which the solution is brought to this temperature. However, a particular feature of the present invention is controlling this particle size by varying catalyst concentration and by varying the concentration of an adducting species, as by adding an adducting amine to the solution or using this amine as the solvent, these features being effective when used individually or together.

EXAMPLES

Further details of the preparation of fine aluminum powders in accordance with the present invention will be apparent from the immediately following detailed Examples 1–3 and from examples in the accompanying TABLE, all of these examples being given to illustrate but not to limit the invention.

The alane adducts used in all of the examples were prepared by well-known reactions typified by $LiAlH_4$ plus either $NMe_3HCl$ or $AlCl_3$ and $NMe_3$, the reactions being carried out by standard Schlenk techniques in organic solvents and under an inert atmosphere.

Example 1

In this example, which is listing "8" in the accompanying table, 12 ml of toluene solution containing 0.2 g of $H_3Al.NMe_3$ as alane adduct and 0.52 g of added TMEDA amine was heated in a flask to 82° C. under argon; 0.001 g of $(i\text{-}PrO)_4Ti$ catalyst was then added while rapidly stirring the mixture. This reaction mixture turned red-brown for 30 seconds; then aluminum powder precipitated. The reaction mixture was then stirred for 25 minutes and cooled to room temperature. The powder slowly settled on standing and the liquid phase was cannulated off. Fresh toluene was added to the solid, stirred, allowed to stand until the solid settled, and the solvent cannulated off. The solid was washed with fresh toluene a second time. The solid was then dried under vacuum and the flask filled with dry argon. Finally, the aluminum powder was passivated by slow oxidation resulting from opening a stopcock of the argon filled flask to the air for 10 minutes.

Example 2

In this example which is similar to listing "14" in the accompanying table, 0.190 g of $TiCl_4$ catalyst in 10 mL of toluene was added to 125 mL of a toluene solution containing $H_3Al$-TMEDA alane adduct in a flask at room temperature. No additional amine was added. The reaction mixture was heated to 110° C. for 1 hour under argon. Aluminum powder formed in the mixture which was then cooled to room temperature. The mixture was then opened to the air by removing a cap of the flask for more than 5 minutes to passivate the aluminum powder by diffusion of atmospheric oxygen through the mixture to the powder. The powder was then isolated by filtration through a fine frit, washed with pentane, washed with diethyl ether, and dried.

Example 3

In this example, which is listing "18" in the accompanying table, a toluene solution containing $H_3Al\text{-}NMe_3$ and TMEDA was added to a rapidly stirred solution of $(i\text{-}PrO)_4Ti$ catalyst in toluene at 110° C. under argon and in a flask. The reaction mixture was stirred for 25 minutes. Aluminum powder formed in the mixture which was then cooled to room temperature. The solid was allowed to settle out of solution, and the organic top layer cannulated off. The solid was washed by adding fresh solvent, stirring, and again cannulating off the organic layer. This washing step was repeated, and the solid dried under vacuum for 30 minutes. After admitting dry argon to the flask, the solid was passivated as in Example 1 by opening a valve on the flask to air for 10 minutes.

Aluminum powders produced by the above examples were characterized by X-ray powder diffraction and found to be highly crystalline, and further information on the above and other examples is listed in the accompanying TABLE. The table listings include results from characterizations of the produced powders by thermal gravimetric analysis (TGA) and scanning electron microscopy (SEM). These characterizations were not performed where table listings are lacking.

In the TGA, the powders were oxidized by heating in air to determine, by the weight gain on oxidation, the weight percent of active aluminum as produced. The TGA results were also used to calculate the size of the produced particles based on the particles having, as produced, an aluminum oxide layer of the generally accepted thickness of about 3.5 nm. The SEM micrographs were collected to determine powder morphology and size. The TABLE compares sizes in nanometers estimated from viewing these micrographs and those calculated from the TGA results.

It will be apparent from the above examples that the present invention is effective when, as in Example 1 and identified as method "1" in the TABLE, the alane adduct solution is heated to the reaction temperature and the catalyst then added; when, as in example 2 and identified as method "2" in the TABLE, the complete mixture of alane adduct and catalyst, which may include an added amine as in examples 1 and 3, is heated to the reaction temperature; and when, as in Example 3 and identified as method "3" in the accompanying TABLE, the alane adduct solution is added to a solution of the catalyst at the reaction temperature. However, the approach of Example 1 was found most convenient for the purpose of experiments wherein other aspects of the present invention were to be varied. In the approach of Example 2, the rate of heating was found to have some effect on the particle size, but this effect has not been fully characterized and is not pertinent to the approaches of Examples 1 and 3 where the catalyst is not added to the solution until it is at the reaction temperature.

Listings 8 and 22 show that the present method is effective with different solvents at temperatures as low as 82 and 50° C.

A comparison of listings 9 and 22 indicates that the reaction temperature by itself does not radically affect the size and purity of the produced particles.

A comparison of listings 19–21 shows that the particle size is affected by the titanium compound used as a catalyst. This effect has not been fully characterized.

In the accompanying TABLE, concentrations of the catalyst are given as the molar ratio of catalyst compound to alane adduct. With the trimethylamine adduct and titanium isopropoxide catalyst, $(i\text{-PrO})_4Ti$, the weight ratio of this catalyst compound to the produced aluminum is thus about 0.00158 at the concentration of 0.015% of listing 5 so that the weight ratio of titanium to aluminum product is about 0.00027. However, in the listing 14, the weight ratio of catalyst compound to produced aluminum is about 1.40 for the dimethylethyl adduct and the titanium chloride, $TiCl_4$, catalyst compound at a molar ratio of 20%.

The TABLE has listings, such as 2–6, where an adducting amine, such as TMEDA, having a greater adducting affinity was added to a solution of an alane adduct having an adducting species, such as trimethylamine, of lesser affinity, the alane adduct with the species of lesser affinity being used because of convenient availability. In the examples of such listings, the amine of greater affinity is believed to have immediately started to displace the amine of lesser affinity from the alane adduct so that fine powder formation in accordance with the present invention was substantially that corresponding to the amine of greater affinity.

TABLE

| | Method | Alane Adduct | Solvent | Amines Added | Reaction Temperature | Catalyst Addition Temperature | Ti Catalyst (Conc) | TGA Calc'd Size (nm) | SEM Est. Avg | Wt % Active Al |
|---|---|---|---|---|---|---|---|---|---|---|
| 1 | 1 | $H_3Al \cdot NMe_3$ | Toluene | None | 110° C. | 100° C. | $(i\text{-PrO})_4Ti$ 0.15% | 254 | 300 | 88.1 |
| 2 | 1 | $H_3Al \cdot NMe_3$ | Toluene | TMEDA | 110° C. | 110° C. | $(i\text{-PrO})_4Ti$ 0.15% | 135 | 200 | 80.1 |
| 3 | 1 | $H_3Al \cdot NMe_3$ | Toluene | t-$BuNH_2$ | 110° C. | 110° C. | $(i\text{-PrO})_4Ti$ 0.15% | 218 | 300 | 86.3 |
| 4 | 1 | $H_3Al \cdot NMe_3$ | Toluene | t-$BuNH_2$ TMEDA | 110° C. | 110° C. | $(i\text{-PrO})_4Ti$ 0.15% | 191 | 250 | 84.5 |
| 5 | 1 | $H_3Al \cdot NMe_3$ | Toluene | TMEDA | 110° C. | 110° C. | $(i\text{-PrO})_4Ti$ 0.015% | 488 | 500 | 93.6 |
| 6 | 1 | $H_3Al \cdot NMe_3$ | Toluene | TMEDA | 110° C. | 110° C. | $(i\text{-PrO})_4Ti$ 1.5% | 112 | 100 | 75.0 |
| 7 | 1 | $H_3Al \cdot NMe_3$ | TMEDA | TMEDA | 110° C. | 110° C. | $(i\text{-PrO})_4Ti$ 0.15% | 70 | | 63.2 |
| 8 | 1 | $H_3Al \cdot NMe_3$ | Toluene | TMEDA | 82° C. | 82° C. | $(i\text{-PrO})_4Ti$ 0.15% | 67 | 250 | 62.2 |
| 9 | 1 | $H_3Al \cdot NMe_3$ | Xylene | TMEDA | 141° C. | 141° C. | $(i\text{-PrO})_4Ti$ 0.15% | 106 | 200 | 73.8 |
| 10 | 1 | $H_3Al \cdot NMe_2Et$ | Toluene | TMEDA | 110° C. | 110° C. | $(i\text{-PrO})_4Ti$ 0.15% | 225 | | 86.6 |
| 11 | 1 | $H_3Al \cdot$ TMEDA | Toluene | TMEDA | 90–95° C. | 90° C. | $TiCl_4$ 3.30% | | | |
| 12 | 1 | $H_3Al \cdot$ TMEDA | Toluene | TMEDA | 90–95 C. | 90° C. | $TiCl_4$ 3.80% | | | |
| 13 | 1 | $H_3Al \cdot NMe_2Et$ | Toluene | TMEDA | 90–95° C. | 90° C. | $TiCl_4$ 0.155% | 500 | 500 | |
| 14 | 2 | $H_3Al \cdot NMe_2Et$ | Toluene | None | 90–95° C. | 25° C. | $TiCl_4$ 20% | 70 | 150 | 63.3 |
| 15 | 2 | $H_3Al \cdot$ Dioxane | Dioxane | None | 90–95° C. | 25° C. | $TiCl_4$ 2% | | | |
| 16 | 2 | $H_3Al \cdot NMe_3$ | Xylene | TMEDA | 138° C. | 82° C. | $(i\text{-PrO})_4Ti$ 0.15% | 157 | 150 | 81.5 |
| 17 | 2 | $H_3Al \cdot NMe_3$ | Xylene | TMEDA | 130° C. | 82° C. | $(i\text{-PrO})_4Ti$ 0.15% | 605 | 350 | 94.8 |
| 18 | 3 | $H_3Al \cdot NMe_3$ | Toluene | TMEDA | 110° C. | 110° C. | $(i\text{-PrO})_4Ti$ 0.15% | 145 | 200 | 80.1 |
| 19 | 1 | $H_3Al \cdot NMe_3$ | Toluene | TMEDA | 110° C. | 110° C. | $(i\text{-PrO})_4Ti$ 0.15% | 230 | | 86.8 |
| 20 | 1 | $H_3Al \cdot NMe_3$ | Toluene | TMEDA | 110° C. | 110° C. | $TiCl_4$ 0.15% | 320 | | 90.4 |
| 21 | 1 | $H_3Al \cdot NMe_3$ | Toluene | TMEDA | 110° C. | 110° C. | $Ti(NMe_2)_4$ 0.15% | 195 | | 84.8 |
| 22 | 1 | $H_3Al \cdot NMe_3$ | Xylene | TMEDA | 50° C. | 50° C. | $(i\text{-PrO})_4Ti$ 0.15% | 110 | 150 | 74.9 |

Taken together, all of the examples listed in the TABLE show that the method of the present invention is effective for the production of fine aluminum powders with a variety of adducting species and combinations thereof, with a variety of solvents, without added amines and with a variety of added amines including mixed amines, in a range of reaction temperatures, and when catalyzed by a number of titanium compounds over a range of concentrations. The listings also show the correlation existing between particle size evaluation by the TGA and the SEM methods. The particular significance of certain of the listings will now be explained.

A comparison of listings 6, 2, and 5 in that order shows a significant discovery of the present invention that decreasing the concentration of the same catalyst compound increases the size of the produced particles. Although not wishing to be bound by theoretical considerations, it is believed that the control over the size of the produced particles provided by this discovery results from the fact that, when there are a relatively small number of initiation sites due to a small concentration of catalyst, the relatively few particles initiated grow to relatively large size. Conversely and when there is a high concentration of catalyst, there are relatively many initiation sites and the larger number of initiated particles have their growth terminated when at a small size when the alane adduct is depleted.

A comparison of listings 1, 2, and 7 shows another significant discovery of the present invention that increasing the concentration of an adducting species decreases size of the produced particles. In listing 1, none of the adducting species was present except in the trimethylamine alane adduct itself; in listing 2, the amine TMEDA was added to the toluene solvent; and, in listing 7, the TMEDA was the solvent and thus the amine added to that in the alane adduct. Again not wishing to be bound by theoretical considerations, it is believed that the control over the size of the produced particles provided by this further discovery is because, when there is a relatively large amount of an adducting species, this species coordinates to the surfaces of already initiated particles reducing the rate of attachment thereto of further aluminum which is available to form a larger number of smaller particles from the amount of alane adduct available in the solution. Conversely, a lower concentration of the adducting species permits already initiated particles to grow at a faster rate resulting in fewer particles of a larger size upon alane adduct depletion. This control over the particle size may also be because the number of nucleation sites is changed by affecting the catalyst.

For a similar reasons, adducting species having greater affinity for aluminum are believed to produce smaller particles, although this has not been fully characterized. Also, it is believed that a lower concentration of alane adduct in a solvent such as toluene which has no such coordinating effect would tend to produce finer particles.

It is believed that a combination of the two above-identified significant discoveries provides a greater effect than either by itself. As a result, by use of a large concentration of catalyst and a relatively large concentration of an adducting species, exceptionally fine aluminum powders of uniform particle size may be produced by the practice of the present invention. Conversely by utilization of a small concentration of catalyst and adducting species, the present invention may provide aluminum powders with particles of selected larger sizes previously only nominally available because no convenient and economical prior art method provides particles both large and uniform in size.

It is believed that one skilled in the art and guided by the above description, examples, and table will require no undue experimentation to provide fine aluminum powders of selected and uniform sizes in accordance with the present invention, since only a few simple experiments using conventional apparatus and with varying concentrations of catalyst and adducting species followed by inspection of the produced particles with well-known techniques will establish the range of sizes produced by the range of varying concentrations.

Modifications and variations of the present invention are possible, and it should be understood that, within the scope of the appended claims, the invention may be practiced otherwise than specifically described.

What is claimed is:

1. A method of producing aluminum particles comprising a decomposition of an alane adduct in a reaction solution including a catalyst and having an organic solvent in an inert atmosphere, wherein:

said alane adduct has an adducting species selected from the group consisting of trimethylamine, dimethylethylamine, methyldiethylamine, triethylamine, tripropylamine, triisopropylamine, tributylamine, pyridine, tetramethylethylenediamine, methyl ether, ethyl ether, propyl ether, isopropyl ether, tetrahydrofuran, dimethoxymethane, diglyme, triglyme, and tetraglyme;

said organic solvent is selected from the group consisting of hexane, heptane, octane, nonane, toluene, benzene, xylene, mesitylene, triethylamine, tripropylamine, triisopropylamine, pyridine, tetramethylethylenediamine, dimethoxymethane, propyl ether, isopropylether, tetrahydrofuran. diglyme, triglyme, and tetraglyme;

said catalyst is selected from the group consisting of halides, alkoxides, and amides of titanium, vanadium, zirconium, niobium, hafnium, and tantalum; and said decomposition occurring at a reaction temperature of between about 50 degrees Centigrade and about 138 degrees Centigrade and wherein said reaction solution is formed by adding a preliminary solution of said alane adduct in said organic solvent to a solution at said reaction temperature and containing said catalyst.

* * * * *